US005267170A

United States Patent [19]

Anbe

[11] Patent Number: 5,267,170

[45] Date of Patent: Nov. 30, 1993

[54] METHOD AND APPARATUS FOR CONTROLLING ROLLING MILL

[75] Inventor: Yoshiharu Anbe, Tokyo, Japan

[73] Assignee: Kabushiki Kaisha Toshiba, Kawasaki, Japan

[21] Appl. No.: 785,793

[22] Filed: Oct. 31, 1991

[30] Foreign Application Priority Data

Nov. 1, 1990 [JP] Japan ..... 2-296906

[51] Int. Cl.[5] ..... B21B 37/12; G06F 15/46

[52] U.S. Cl. ..... 364/472; 364/148; 364/563; 72/8; 72/10; 72/16

[58] Field of Search ..... 364/150, 472, 476, 563, 364/148; 72/10, 13, 12, 16, 8

[56] References Cited

U.S. PATENT DOCUMENTS

| | | | |
|---|---|---|---|
| 3,442,104 | 5/1969 | Misaka et al. | 72/12 |
| 4,289,005 | 9/1981 | Cabaret et al. | 72/12 |
| 4,400,957 | 8/1983 | Carlstedt et al. | 72/8 |
| 4,428,054 | 1/1984 | Alzawa et al. | 364/472 |
| 4,537,050 | 8/1985 | Bryant et al. | 72/8 |
| 4,633,692 | 1/1987 | Watanabe | 72/8 |
| 4,633,693 | 1/1987 | Tahara et al. | 72/8 |
| 4,805,492 | 2/1989 | Tsuruda | 72/8 |
| 4,907,434 | 3/1990 | Hoshino et al. | 72/8 |
| 5,047,964 | 9/1991 | Lalli | 364/557 |

FOREIGN PATENT DOCUMENTS

| | | |
|---|---|---|
| 0063605 | 11/1982 | European Pat. Off. . |
| 202814 | 10/1983 | Fed. Rep. of Germany . |
| 3331335 | 3/1985 | Fed. Rep. of Germany . |
| 0099210 | 4/1990 | Japan . |
| 8809702 | 12/1988 | World Int. Prop. O. . |

*Primary Examiner*—Jerry Smith
*Assistant Examiner*—Paul Gordon
*Attorney, Agent, or Firm*—Oblon, Spivak, McClelland, Maier & Neustadt

[57] ABSTRACT

According to this invention, a rolled sheet rolled by a reduction roll of a rolling mill is divided into a plurality of areas in a direction of its width, and sheet flatness or thickness values are measured in the plurality of areas. Bending forces, leveling value, shift amounts, and the like applied, by actuators respectively arranged at drive and work sides of the reduction roll, from the drive and work sides of the reduction roll are calculated in accordance with the sheet flatness or thickness measurement values and influence coefficients of the actuators. The actuators on the drive and work sides of the reduction roll are independently operated in accordance with these operation amounts.

5 Claims, 5 Drawing Sheets

METHOD AND APPARATUS FOR CONTROLLING ROLLING MILL

BACKGROUND OF THE INVENTION

1. Field of the Invention

The present invention relates to a method and apparatus for controlling a rolling mill for rolling a rolled sheet of a metal or the like and, more particularly, to a method and apparatus for controlling operation amounts supplied to actuators respectively arranged in work and drive sides of the rolling mill to adjust the sheet flatness or sheet crown of the rolled sheet.

2. Description of the Related Art

In recent years, various market needs for hot and cold rolling sheet plates and surface treated steel sheets have arisen in terms of not only mass production but also quality improvements and shortening of delivery due. In order to immediately satisfy these market needs, various methods of controlling rolling mills have been proposed.

Of these methods, a recent control method is disclosed in "Method of Controlling Shape of Rolled Sheet", *Nihon Kokan Giho* No. 122, 1989. This method associated with control of the sheet flatness of rolled sheets. More specifically, a detected shape of a rolled sheet is represented by a function f(x) normalized in a direction of sheet width and is approximated by an orthonormal function $\Phi_i(x)$ of a maximum of the sixth degree as follows:

$$f(x) = \sum_{i=0}^{6} A_i\Phi_i(x) + \epsilon(x) \quad (1)$$

where x is the position in the direction of sheet width, satisfying condition $-1 \leqq x \leqq 1$, and $$A_i = \int_{-1}^{1} f(x)\Phi_i(x) \text{ and } \epsilon(x)$$

are terms of a degree equal to or higher than the sixth degree.

If a change in shape by an operation amount $\Delta J_j$ of a shape control device j is defined as $\Delta F_j(x)$, a predicted shape obtained upon operation of n devices by a predetermined amount is represented by equation (2) below:

$$g(x) = f(x) \sum_{j=0}^{n} \Delta F_j(x) \quad (2)$$

An evaluation function in shape control is given by equation (3) when a target shape is represented as f(x):

$$\begin{aligned} \Phi &= \int \{g(x) - f^*(x)\}^2 dx \\ &= \int \left\{ f(x) - \sum_{j=1}^{n} JF_j(x) - f^*(x) \right\}^2 dx \end{aligned} \quad (3)$$

A minimum value of the evaluation function is obtained by $\Delta J_j$ obtained by equation (4) below:

$$\Phi/\Delta J_j = O \ (j=1 \text{ to } n) \quad (4)$$

In this case, by giving $(\partial F/\partial J)_j$, simultaneous equations (4) are solved to obtain a control output of each shape control device.

Coarse control is performed by the above output determining scheme, and remaining amounts, i.e., values of the sixth or higher degrees in equation (1) are corrected by fine control.

As described above, conventional flatness control of a rolled sheet is performed in the range of $-1 \leqq X \leqq 1$, i.e., in the entire width. That is, the conventional flatness control collectively performs operations throughout the width of the sheet.

In a rolled sheet actually rolled by a rolling mill, the sheet flatness or sheet crown of a portion extending from the center to a work side (WS) of the sheet is not necessarily symmetrical with that from the center to a drive side (DS) of the sheet, thereby degrading precision of flatness and crown control. This drawback typically occurs in particularly wide rolled sheets.

In recent years, strong demand has arisen for improving quality (yield) of wide rolled sheets (i.e., rolled sheets having widths of about 1,000 to 2,000 mm).

In the conventional method of controlling the rolling mill, since control is collectively performed throughout the entire width of the sheet, the sheet flatness or sheet crown of the rolled sheet cannot be controlled with high precision.

SUMMARY OF THE INVENTION

It is an object of the present invention to provide a method and apparatus for controlling a rolling mill, wherein the sheet flatness or sheet crown of a rolled sheet can be adjusted to a desired value with high precision.

In order to achieve the above object, according to an aspect of the present invention, there is provided a method of controlling a rolling mill, wherein a rolled sheet rolled by a reduction roll of the rolling mill is divided into a plurality of areas in a direction of width thereof, a sheet flatness of the rolled sheet is measured in the plurality of areas, and operation amounts such as a bending force, a leveling force, and a shift force applied, by actuators respectively arranged at the drive and work sides of the reduction roll, from the drive and work sides thereof to the reduction roll are calculated in accordance with each flatness measurement value and influence coefficients of the actuators, the influence coefficients representing degrees of influences on the sheet flatness by the operation amounts applied from the actuators to the reduction roll. The actuators for the drive and work sides of the reduction roll are independently operated in accordance with the operation amounts. By controlling the rolling mill in this manner, the sheet flatness and crown of the rolled sheet can be adjusted to a desired value with high precision.

In order to achieve the above object, a rolled sheet produced by a reduction roll of the rolling mill is divided into a plurality of areas in a direction of its width, and the thickness of the rolled sheet is measured in the plurality of areas to obtain a sheet crown. Operation amounts applied by the actuators from the drive and work sides of the reduction roll are obtained in accordance with influence coefficients of the actuators which influence the sheet flatness and crown and with the sheet crown measurement values. The actuators for the drive and work sides of the reduction roll are independently operated in accordance with the calculated operation amounts. Therefore, the sheet flatness and crown of the rolled sheet can be adjusted to a desired value by the above operations.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A preferred embodiment of the present invention will be described in detail with reference to the accompanying drawings.

Figure 1:
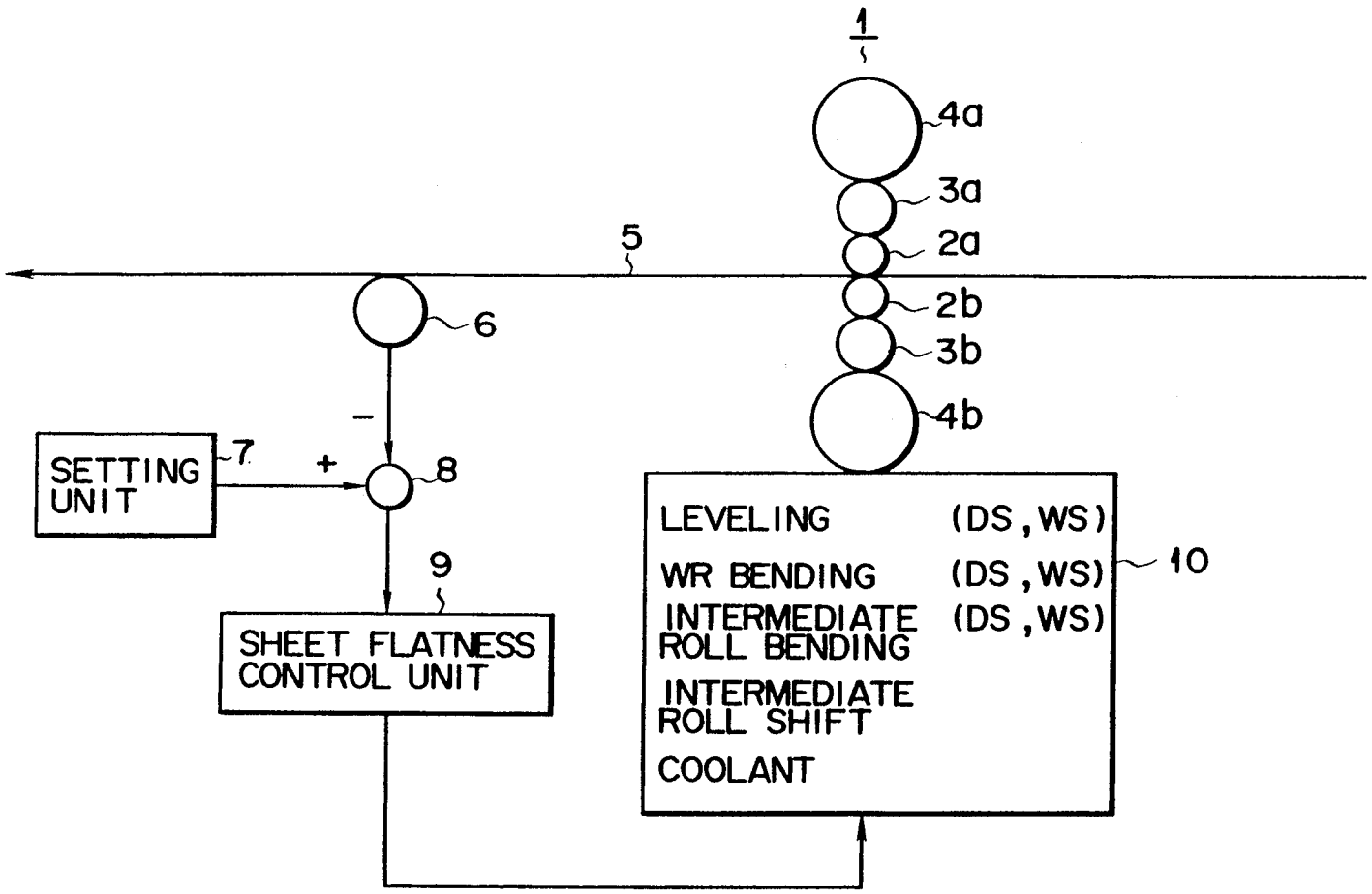
FIG. 1 is a diagram showing a schematic arrangement of an apparatus for controlling a rolling mill according to an embodiment of the present invention.

FIG. 1 is a block diagram showing an arrangement of a control apparatus for realizing a method of controlling a rolling mill according to the present invention. In this embodiment, a rolling mill 1 as a target object comprises a six-high rolling mill having reduction rolls consisting of a pair of work rolls (WR) 2*a* and 2*b*, a pair of intermediate rolls (IMR) 3*a* and 3*b*, and a pair of backup rolls 4*a* and 4*b*.

The control apparatus for a rolling mill of this embodiment comprises a sheet flatness measuring device 6 for dividing a rolled sheet 5 rolled by the rolling mill 1 into N areas in a direction of its width and measuring flatness values in the N areas, a sheet flatness setting unit 7 for setting a sheet flatness reference of the rolled sheet, an adder 8 for calculating a difference between the sheet flatness measurement value and the sheet flatness reference, a sheet flatness control unit 9, and actuators 10.

Figure 2:
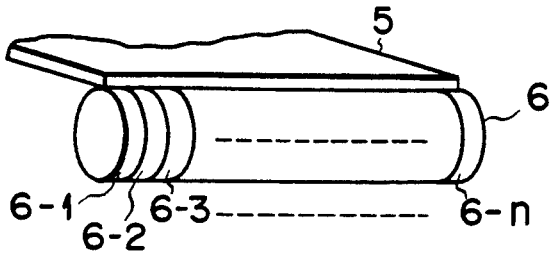
FIG. 2 is a view showing a schematic arrangement of a sheet flatness gauge arranged in the apparatus for controlling the rolling mill according to this embodiment.
Figure 3:
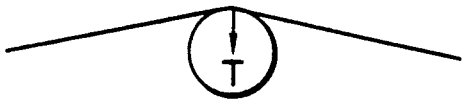
FIG. 3 is a diagram showing the principle of measurement of the sheet flatness gauge.

As shown in FIG. 2, the sheet flatness measuring device 6 comprises n pressure sensors 6-1 to 6-*n* which are divided in, e.g., the direction of width of the rolled sheet 5 and independently detect pressures of the n areas of the rolled sheet 5. The n pressure sensors 6-1 to 6-*n* are combined so as to have the same roll diameter, as shown in FIG. 2. Each of the pressure 6-1 to 6-*n* receives a pressure T (FIG. 3) from a corresponding contact portion of the rolled sheet 5. Since the pressure T changes in accordance with the sheet flatness of the rolled sheet 5, measurements of the pressures acting on the respective pressure sensors 6-1 to 6-*n* allow measurements of the sheet flatness values of the rolled sheet 5 in the n areas divided in the direction of its width.

The sheet flatness setting unit 7 sets desired n (plurality) sheet flatness reference of the respective n areas divided in the direction of sheet width. The adder 8 calculates differences between the n sheet flatness values measured by the sheet flatness measuring device 6 and the desired sheet flatness values set by the sheet flatness setting unit 7 and outputs the calculated values as sheet flatness differences.

The sheet flatness control unit 9 inputs the sheet flatness differences calculated by the adder 8 and calculates operation amounts for independently driving the actuators arranged at the work and drive sides of the rolling mill 1, by using the influence coefficients for the sheet flatness values of the actuators 10 of the rolling mill 1. The calculated operation amounts are independently output to the actuators 10.

The actuators 10 comprise various actuators such as a roll bender, a leveler, a shifter, and a coolant unit.

Figure 4:
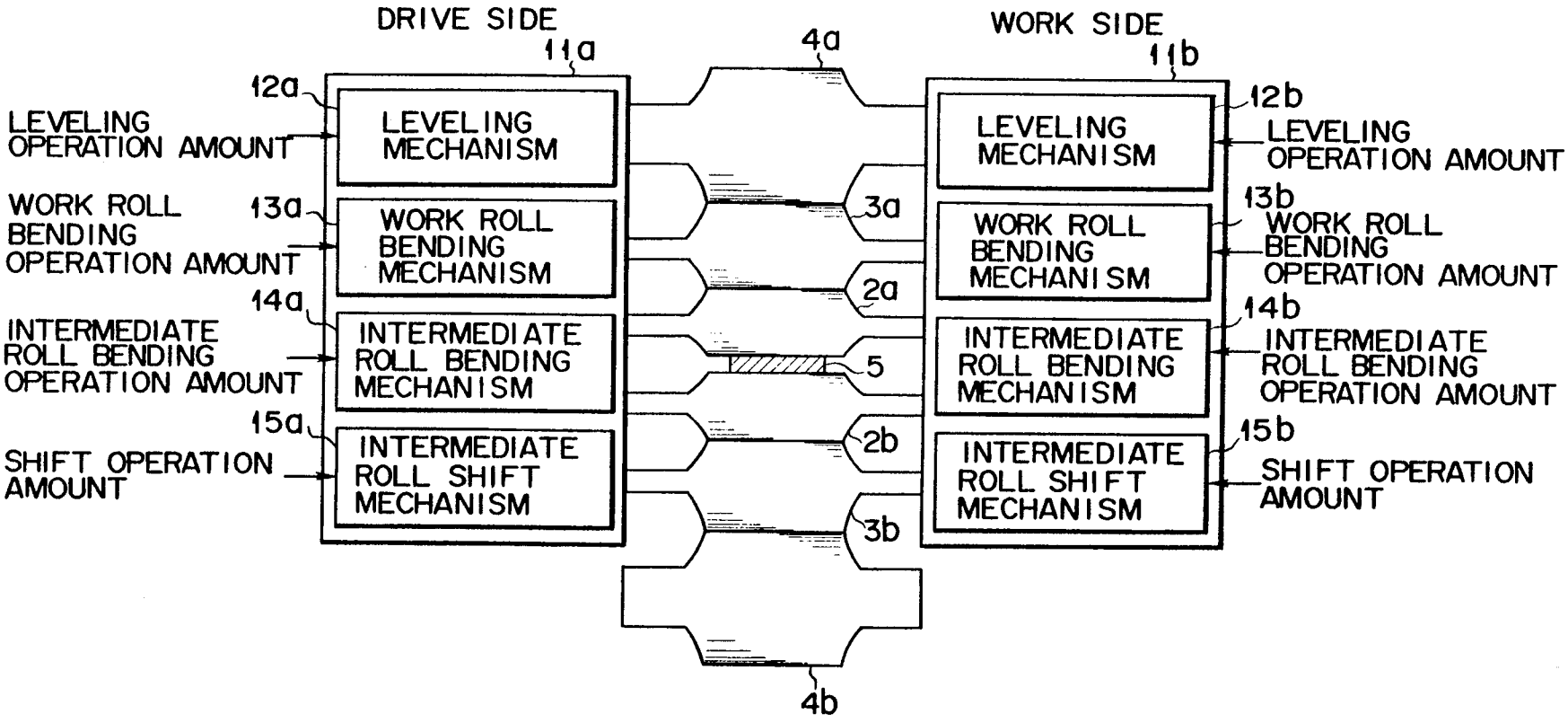
FIG. 4 is a perspective view showing a schematic arrangement of an actuator portion operated in the apparatus for controlling the rolling mill of this embodiment.

As shown in FIG. 4, in this embodiment, actuators 11*a* and 11*b* are arranged at the drive and work sides, respectively, of the reduction roll. The actuator 11*a* comprises a leveling mechanism 12*a* , a work roll bending mechanism 13*a*, an intermediate roll bending mechanism 14*a*, and an intermediate roll shift mechanism 15*a*.

The leveling mechanism 12*a* increases or decreases a roll gap at the drive side of the reduction roll in accordance with an operation amount from the sheet flatness control unit 9. The work roll bending mechanism 13*a* supports drive side bearings of the work rolls 2*a* and 2*b* (e.g., by means of hydraulic cylinders) and bends the drive sides of the work rolls 2*a* and 2*b* by a bending force corresponding to an operation amount from the sheet flatness control unit 9. The intermediate roll bending mechanism 14*a* supports the drive side bearings of the intermediate rolls 3*a* and 3*b* (e.g., by means of hydraulic cylinders) and bends the drive sides of the intermediate rolls by a bending force corresponding to an operation amount from the sheet flatness control unit 9. The intermediate roll shift mechanism 15*a* shifts the upper and lower intermediate rolls 3*a* and 3*b* by the same distance but in opposite directions in accordance with an operation amount from the sheet flatness control unit 9.

The work side actuator 11*b* comprises a leveling mechanism 12*b*, a work roll bending mechanism 13*b*, an intermediate roll bending mechanism 14*b*, and an intermediate roll shift mechanism 15*b*. The functions of these mechanisms are identical to those of the drive side.

Figure 5:
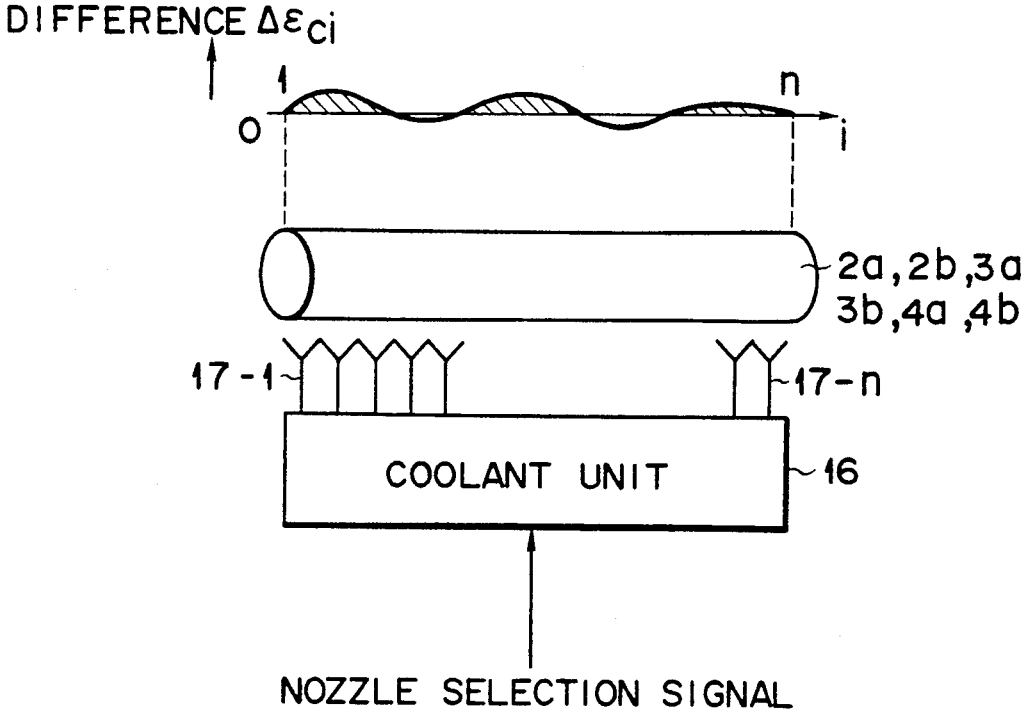
FIG. 5 is a schematic view showing a coolant unit as one of the actuators operated in the apparatus for controlling the rolling mill according to this embodiment.

As shown in FIG. 5, a coolant unit 16 has n coolant nozzles 17-1 to 17-*n* which cover the entire width of coolant unit 16 injects a coolant from predetermined nozzles 17 in accordance with a nozzle selection signal from the sheet flatness control unit 9.

Figure 6:
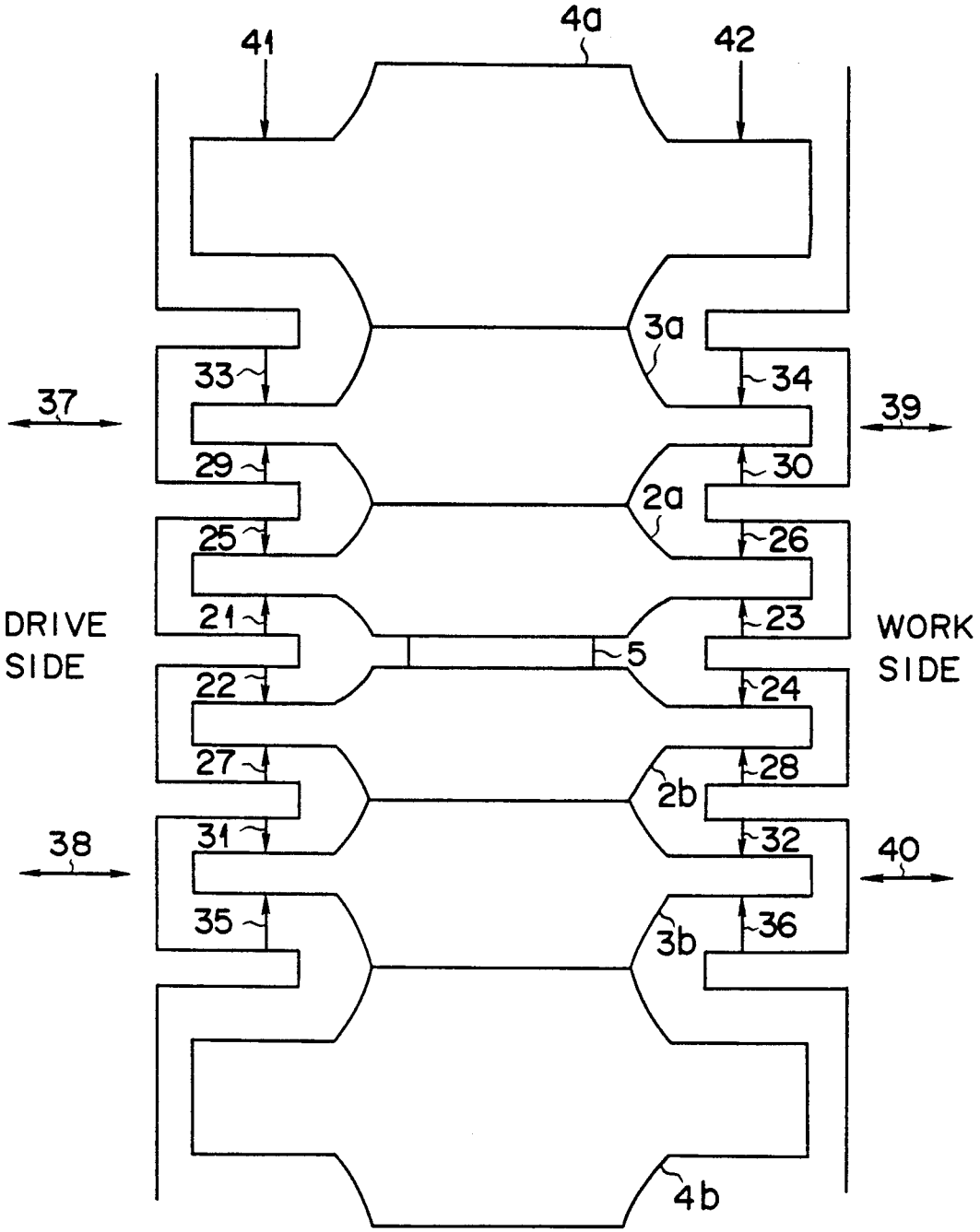
FIG. 6 is a view showing a relationship between a reduction roll controlled by the apparatus for controlling the rolling mill of the embodiment and operation amounts.

FIG. 6 is a schematic view showing a relationship between the reduction rolls of the rolling mill 1 and the actuators 10. Forces acting on the reduction rolls from the drive and work side actuators 11*a* and 11*b* are indicated by arrows, respectively.

Referring to FIG. 6, reference numerals 21, 22, 25, and 27 denote work roll bending forces on the drive side; 23, 24, 26, and 28, work roll bending forces on the work side; 29, 31, 33, and 35, intermediate roll bending forces on the drive side; 30, 32, 34, and 36, intermediate roll bending forces on the work side; 41, a leveling on the drive side; and 42, a leveling on the work side.

These actuators 11*a* and 11*b* are usually constituted by hydraulic cylinders. However, the actuators 11*a* and 11*b* may comprise powered or pneumatic cylinders, respectively.

A method of controlling the rolling mill according to this embodiment will be described below.

Figure 7:
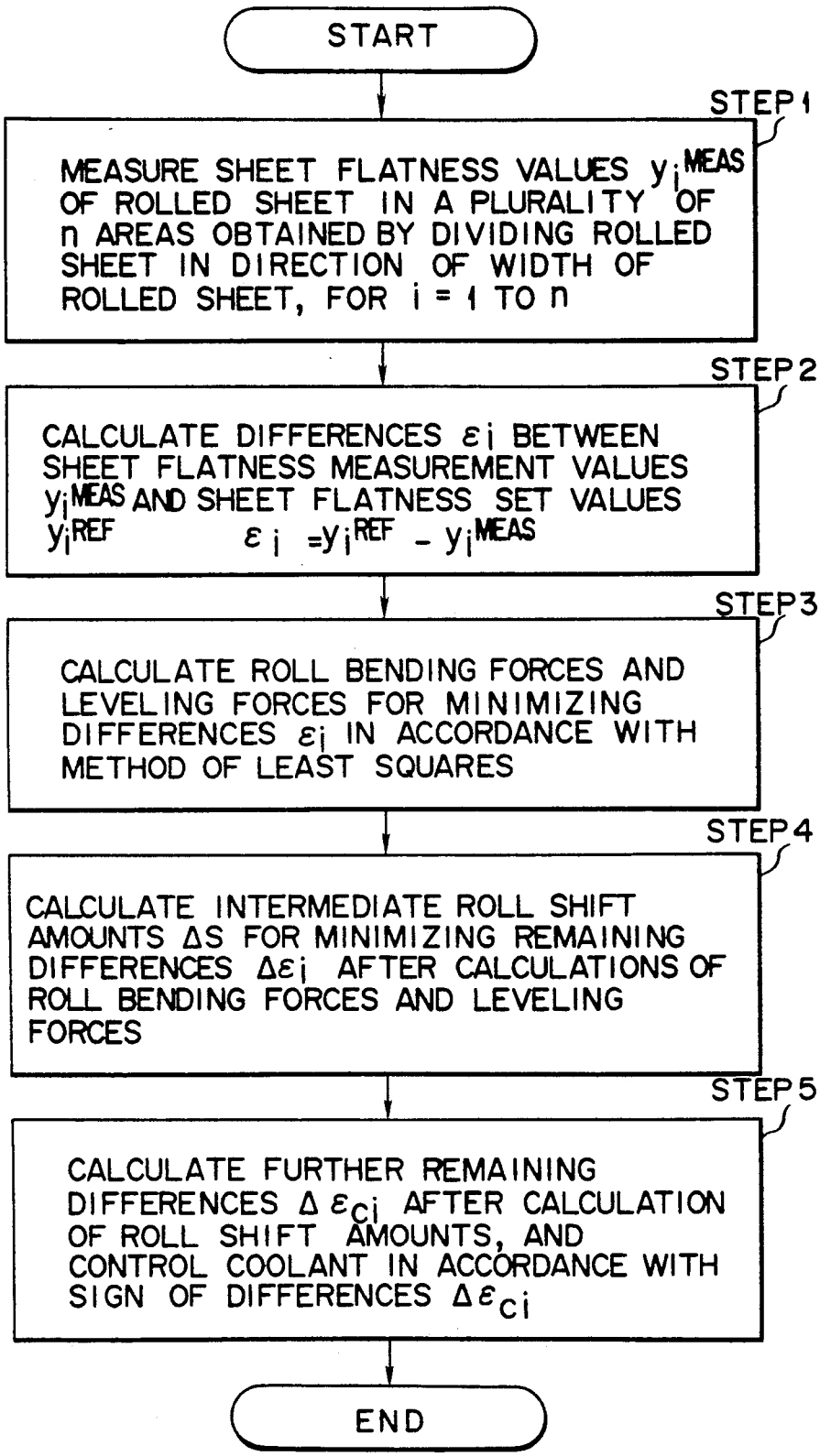
FIG. 7 is a flow chart for calculating actuator operation amounts in the apparatus for controlling the rolling mill according to this embodiment.

FIG. 7 is a flow chart associated with rolling mill control of this embodiment.

In step 1, flatness values of the rolled sheet 5 rolled by the rolling mill 1 are measured by the sheet flatness measuring device 6.

The n sheet flatness reference of the n areas divided in the direction of sheet width are set by the sheet flatness setting unit 7 in advance.

That is, desired sheet flatness values $$y_i REF(i=1 \text{ to } n) \tag{5}$$

are supplied from the sheet flatness setting unit 7 to the adder 8. In the above equation, i is a division count in the direction of sheet width and is equal to the number of divisions of the sheet flatness gauge 6. If the division is performed, e.g., every 50 mm, then n =20 for a sheet having a width of 1000 mm.

The sheet flatness values measured by the sheet flatness gauge 6 are supplied to the adder 8 as follows:

$$y_i MEAS(i=1 \text{to } n) \tag{6}$$

In step 2, the adder 8 calculates sheet flatness differences $\epsilon_i$ between the measured flatness values and the preset flatness reference as follows:

$$\epsilon_i = Y_i^{REF} - Y_i^{MEAS} \tag{7}$$

for $i=1$ to $n$.

The sheet flatness differences $\epsilon_i$ calculated by the adder 8 are supplied to the sheet flatness control unit 9. The sheet flatness control unit 9 calculates operation amounts for independently operating the actuators 11*a* and 11*b* on the work and drive sides, by using influence coefficients for the sheet flatness values of the actuators 10 of the rolling mill 1, on the basis of the sheet flatness differences $\epsilon_i$.

A sheet flatness evaluation function $J_{DS}$ on the drive side and a sheet flatness evaluation function $J_{WS}$ on the work side are defined as follows:

$$J_{DS} = \sum_{i=1}^{n/2} \{\epsilon_i - (\partial y_i/\partial F_{WDS}) \cdot \Delta F_{WDS} - (\partial y_i/\partial F_{IDS}) \cdot \Delta F_{IDS} - (\partial y_i/\partial L_{DS}) \cdot \Delta L_{DS}\}^2 \tag{8}$$

$$J_{WS} = \sum_{i=n/2+1}^{n} \{\epsilon_i - (\partial y_i/\partial F_{WWS}) \cdot \Delta F_{WWS} - (\partial y_i/\partial F_{IWS}) \cdot \Delta F_{IWS} - (\partial y_i/\partial L_{WS}) \cdot \Delta L_{WS}\}^2 \tag{9}$$

where $\partial y_i/\partial F_{WDS}$ is the influence coefficient for an influence on the sheet flatness from the drive side work roll bender, $\partial y_i/\partial F_{WWS}$ is the influence coefficient for an influence on the sheet flatness from the work side work roll bender, $\Delta F_{WDS}$ is the work roll bending force (bending operation amount) on the drive side, $\Delta F_{WWS}$ is the work roll bending force (bending operation amount) on the work side, $\partial y_i/\partial F_{IDS}$ is the influence coefficient for an influence on the sheet flatness from the drive side intermediate roll bender, $\partial y_i/\partial F_{IWS}$ is the influence coefficient for an influence on the sheet flatness from the work side intermediate roll bender, $\Delta F_{IDS}$ is the intermediate roll bending force (bending operation amount) on the drive side, $\Delta F_{IWS}$ is the intermediate roll bending force (bending operation amount) on the work side, $\partial y_i/\partial_{LDS}$ is the influence coefficient for an influence on the sheet flatness from the drive side leveling, $\partial y_i/\partial L_{WS}$ is the influence coefficient for an influence on the sheet flatness from the work side leveling, LDS is the drive side leveling, and LWS is the work side leveling.

Operation amounts (i.e., the work roll bending forces, the intermediate roll bending forces, and the roll leveling value) for minimizing the evaluation functions $J_{DS}$ and $J_{WS}$ on both the drive and work sides are obtained in accordance with a method of least squares (step 3).

The influence coefficients $\partial y_i/\partial F_{WDS}$, $\partial y_i/\partial F_{WWS}$, $\partial y_i/\partial F_{IDS}$, $\partial y_i/\partial F_{IWS}$, $\partial y_i/\partial_{LDS}$, $\partial y_i/\partial L_{WS}$, and the like can be calculated or obtained from rolling experiments if the rolling mill 1, the rolled sheet 5, and rolling schedule (e.g., the type of steel, input and output thicknesses, sheet width, and peripheral speed of each reduction roll) are determined. Values for the actuators 11*a* and 11*b* are derived from equations (8) and (9).

The sheet flatness control unit 9 supplies the calculated operation amounts to the drive and work side actuators 11*a* and 11*b* of the rolling mill 1, and the actuators 11*a* and 11*b* apply these operation amounts to the corresponding reduction rolls.

If the obtained operation amounts of the actuators 11*a* and 11*b* are defined as $\Delta F^c_{WDS}$, $\Delta F^c_{WWS}$, $\Delta F^c_{IDS}$, $\Delta F^c_{IWS}$, $\Delta L^c_{DS}$, and $\Delta L^c_{WS}$, when control amounts derived from the above operation amounts are subtracted from the differences $\epsilon_i$ obtained by the adder 8, the remaining differences can be obtained (step 4). That is, the following values are obtained. For drive side, $$\Delta\epsilon_{DS,i} = \epsilon_i - (\partial y_i/\partial F_{WDS}) \cdot \Delta F^c_{WDS} - (\partial y_i/\partial F_{IDS}) \cdot \Delta F^c_{IDS} - (\partial y_i/\partial L_{DS}) \cdot \Delta L^c_{DS} \tag{10}$$

for $i=1$ to $n/2$.

For work side, $$\Delta\epsilon_{WS,i} = \epsilon_i - (\partial y_i/\partial F_{WWS}) \cdot \Delta F^c_{WWS} - (\partial y_i/\partial F_{IWS}) \cdot \Delta F^c_{IWS} - (\partial y_i/\partial L_{WS}) \cdot \Delta L^c_{WS} \tag{11}$$

for $i = (n/2) + 1$ to $n$

Flatness control by the intermediate roll shifts is performed such that the lower intermediate roll 3*b* is shifted to the drive side by the same value as that of the upper intermediate roll 3*a* to the work side.

Assuming $i=1$ to $n$, the following equation is obtained:

$$\Delta\epsilon_i = \Delta\epsilon_{DS,i} \, (i=1 \text{ to } n/2) + \Delta\epsilon_{WS,i} \, (i=(n/2)+1 \text{ to } n) \tag{12}$$

so that an intermediate roll shift amount ΔS is obtained as follows:

$$J_S = \sum_{i=1}^{n} \{\Delta\epsilon_i - (\partial y_i/\partial S) \cdot \Delta S\}^2 \rightarrow \text{MIN} \quad (13)$$

The obtained intermediate roll shift amount ΔS is supplied from the sheet flatness control unit 9 to the intermediate roll shift mechanisms 15*a* and 15*b* on the drive and work sides. The intermediate roll shift mechanisms 15*a* and 15*b* apply this operation amount to the intermediate rolls 3*a* and 3*b*.

The influence coefficient $\partial y_i/\partial S$ represents an influence exerted on sheet flatness by the intermediate roll shift and can be obtained if the rolling mill 1, the rolled sheet 5, and the rolling schedule are determined.

The obtained intermediate roll shift amount is defined as $\Delta S^c$.

Control associated with the coolant unit 16 is left as control associated with the actuators 10. For the sake of descriptive simplicity, the coolant nozzles 17-1 to 17-*n* are arranged at positions measured by the flatness measuring device 6 in the n areas in the direction of sheet width.

The sheet flatness control unit 9 performs operations according to equation (14) below:

$$\Delta\epsilon_{ci} = \{\Delta\epsilon_i - (\partial y_i/\partial S) \cdot \Delta S^c\} \quad (14)$$
$$\text{for } i = 1 \text{ to } n$$

For each $i=1$ to $n$, polarity of the value $\Delta\epsilon_{ci}$ is determined. If the value Azci is positive, a nozzle selection signal for turning on the ith coolant nozzle (i.e., the coolant is injected to the reduction roll) is output to the coolant unit 16. However, if the value $\Delta\epsilon_{ci}$ is negative, a nozzle selection signal for turning off the ith coolant nozzle is output to the coolant unit 16 (step 5).

A command for turning on/off the coolant unit 16 represents the nozzle selection signal representing the polarity of the value $\Delta\epsilon_{ci}$.

As described above, the operations represented by equations (1) to (4) are performed by the adder 8, and the operations represented by equations (5) to (14) are performed by the sheet flatness control unit 9, thereby obtaining the operation amounts for the actuators 10. These operation amounts are applied to the actuators 11*a* and 11*b*, so that the actuators 11*a* and 11*b* on the work and drive sides are independently operated. Therefore, the sheet flatness values on the output work and drive sides of the rolling mill 1 can be independently controlled to desired values.

As described above, according to this embodiment, the apparatus comprises the sheet flatness measuring device 6 for measuring sheet flatness values in the n (plurality) areas in the direction of width of the rolled sheet 5 made of a metal sheet or the like rolled by the rolling mill 1, the sheet flatness setting unit 7 for setting desired n sheet flatness values in the direction of sheet width, the adder 8 for calculating the differences between the sheet flatness values measured by the sheet flatness measuring device 6 and the desired sheet flatness values (reference) set by the sheet flatness setting unit 7 and outputting the calculated values as the sheet flatness differences, and the sheet flatness control unit 9 for calculating operation amounts for independently operating the work and drive side actuators 11*a* and 11*b* by using the influence coefficients for the sheet flatness of the actuators of the rolling mill 1, on the basis of the sheet flatness differences calculated by the adder 8, and the work and drive side actuators 11*a* and 11*b* can be independently operated in accordance with the operation amounts from the sheet flatness control unit 9. Therefore, the sheet flatness values on the output work and drive sides of the rolling mill 1 can be automatically controlled to desired values with high precision. The apparatus of this embodiment can flexibly cope with recent strong demand having arisen for improving quality of wide rolled sheets (i.e., sheets having widths of 1,000 to 2,000 mm).

The present invention is not limited to the particular embodiment described above. Various changes and modifications may be made within the spirit and scope of the invention.

The above embodiment exemplifies the 6-high rolling mill. However, the present invention is not limited to this. For example, the present invention is equally applicable to 2-, 3-, 4-, and 5-high rolling mills, a 12-high rolling mill, and a 20-high rolling mill, which have different numbers of rolls per stand, thereby controlling the sheet flatness.

In the above embodiment, the actuators 10 are arranged to control leveling (DS and WS), WR bending (DS and WS), intermediate roll bending (DS and WS), intermediate roll shifting, and a roll coolant operation. Even if the number of actuators is changed, sheet flatness can be controlled as described above by applying the present invention to this control.

For example, in a rolling mill having no intermediate roll shifting, the terms associated with the intermediate roll shifting can be omitted. When the number of actuators is increased, terms corresponding to the added rolls are added, thereby controlling the sheet flatness in accordance with the same method as described above.

The above embodiment exemplifies control of the sheet flatness. However, the method and apparatus for controlling a rolling mill can be applied to a case wherein a sheet crown as a thickness distribution in the direction of sheet width is controlled to a desired value.

In this case, in place of the sheet flatness gauge, i (=1 to n) sheet thickness gauges are arranged in the direction of sheet width, and the actuator influence coefficients are used as values for the sheet crown. These changes and modifications are apparent to those who are skilled in the art. By performing these simple changes and modifications, the sheet crown can also be controlled as in control of the sheet flatness.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of controlling a rolling mill, comprising:

a first step of dividing a rolled sheet rolled by a reduction roll of said rolling mill into a plurality of areas in a direction of width thereof and measuring a plurality of sheet flatness values of the rolled sheet which correspond to the plurality of areas, wherein said reduction roll includes a pair of work rolls, a pair of intermediate rolls, and a pair of backup rolls, and wherein said first step comprises a step of dividing a rolled sheet produced by a reduction roll of said rolling mill into n areas in a direction of width thereof and measuring n sheet flatness values of the rolled sheet which correspond to the n areas; and a second step of calculating operation amounts to be applied from actuators respectively arranged at drive and work sides of said reduction roll to said reduction roll in accordance with the sheet flatness measurement values obtained in said first step and influence coefficients of said actuators, the influence coefficients representing degrees of influences on the sheet flatness of said rolled sheet by the operation amounts applied from said actuators to said reduction roll, and independently operating the actuators on the drive and work sides of said reduction roll in accordance with the operation amounts, wherein said second step comprises:

a step of calculating differences between a sheet flatness reference of said rolled sheet and then sheet flatness measurement values, to obtain sheet flatness difference $\epsilon_i$, a step of setting a drive side evaluation function $J_{DS}$ and a work side evaluation function $J_{WS}$ as follows:

$$J_{DS} = \sum_{i=1}^{N/2} \{\epsilon_i - (\partial y_i/\partial F_{WDS}) \cdot \Delta F_{WDS} - (\partial y_i/\partial F_{IDS}) \cdot \Delta F_{IDS} - (\partial y_i/\partial L_{DS}) \cdot \Delta L_{DS}\}^2$$

$$J_{WS} = \sum_{i=n/2+1}^{n} \{\epsilon_i - (\partial y_i/\partial F_{WWS}) \cdot \Delta F_{WWS} - (\partial y_i/\partial F_{IWS}) \cdot \Delta F_{IWS} - (\partial y_i/\partial L_{WS}) \cdot \Delta L_{WS}\}^2$$

where as for said work rolls, $\Delta F_{WDS}$ is a work roll bending force on the drive side, $\partial y_i/\partial F_{WDS}$ is an influence coefficient for a bending influence from the drive side, $\Delta F_{WWS}$ is a work roll bending force from the work side, and $\partial y_i/\partial F_{WWS}$ is an influence coefficient for a bending influence from the work side, as for said intermediate rolls, $\Delta F_{IDS}$ is an intermediate roll bending force from the drive side, $\partial y_i/F_{IDS}$ is an influence coefficient for a bending influence from the drive side, $\Delta F_{IWS}$ in an intermediate roll bending force from the work side, and $\partial y_i/\partial F_{TWS}$ is an influence coefficient for a bending influence from the work side, and as for said backup rolls, $\Delta L_{DS}$ is a leveling value from the drive side, and $\Delta L_{WS}$ is a leveling value from the work side, and a step of calculating the forces $\Delta F_{WDS}$, $\Delta F_{IDS}$, and $\Delta L_{DS}$, which minimize the evaluation function $J_{DS}$, to obtain the operation amounts on the drive side according to a method of least squares, and the forces $\Delta F_{WWS}$, $\Delta F_{TWS}$, and $\Delta L_{WS}$, which minimize the evaluation function $J_{WS}$, as to obtain the operation amounts on the work side according to the method of least squares.

2. A method according to claim 1, wherein said second step comprises a step of subtracting sheet flatness control amounts obtained from the operation amounts, which are the forces $\Delta F_{WDS}$, $\Delta F_{IDS}$, and $\Delta L_{DS}$ of the drive side derived from the evaluation function $J_{DS}$, from the sheet flatness differences $\epsilon_i$ of the drive side to obtain remaining differences $\Delta\epsilon_{DS,i}$ on the drive side, a step of subtracting sheet flatness control amounts obtained by the operation amounts, which are the forces $\Delta F_{WWS}$, $\Delta F_{IWS}$, and $\Delta L_{WS}$ of the work side derived from the evaluation function $J_{WS}$, from the sheet flatness differences $\epsilon_i$ of the work side to obtain remaining differences $\Delta\epsilon_{WS,i}$ on the work side, a step of adding the remaining differences $\Delta\epsilon_{DS,i}$ and $\Delta\epsilon_{WS,i}$ on the drive and work sides to obtain a composite remaining difference $\Delta\epsilon_i$, a step of setting an intermediate roll shift evaluation function Js as follows:

$$J_S = \sum_{i=1}^{n} \{\Delta\epsilon_i - (\partial y_i/\partial S) \cdot \Delta S\}^2$$

where $\partial y_i/\partial S$ is an influence coefficient for a shift of said intermediate roll and S is an intermediate roll shift amount, and a step of calculating, in accordance with the method of least squares, the intermediate roll shift amount $\Delta S$, which minimize the evaluation function $J_s$, to obtain the operation amount for the shift of the intermediate roll.

3. A method according to claim 2, wherein the drive side remaining differences $\Delta\epsilon_{DS,i}$ are obtained by the following equation:

$$\Delta\epsilon_{DS,i} = \epsilon_i - (\partial y_i/\partial F_{WDS}) \cdot \Delta F_{WDS} - (\partial y_i/\partial F_{IDS}) \cdot \Delta F_{IDS} - (\partial y_i/\partial L_{DS}) \cdot \Delta L_{DS}$$

for $i = 1$ to $n/2$ and the work side remaining differences $\Delta\epsilon_{WS,i}$ are obtained by the following equation:

$$\Delta\epsilon_{WS,i} = \epsilon_i - (\partial y_i/\partial F_{WWS}) \cdot \Delta F_{WWS} - (\partial y_i/\partial F_{IWS}) \cdot \Delta F_{IWS} - (\partial y_i/\partial L_{WS}) \cdot \Delta L_{WS}$$

for $i = (n/2) + 1$ to $n$.

4. A method according to claim 2, further comprising a fourth step of subtracting the sheet flatness control amounts, which are obtained from the intermediate roll shift amount $\Delta S$ derived from the evaluation function $J_s$, from the composite remaining differences $\Delta\epsilon_i$, and selecting a coolant nozzle for injecting a coolant to said reduction roll, said coolant nozzle being selected from a plurality of coolant nozzles arranged in an axial direction of said reduction roll.

5. A method according to claim 4, wherein said fourth step comprises a step of calculating a differences sci according to the following equation:

$$\Delta\epsilon_{ci} = \{\Delta\epsilon_i - (\partial y_i/\partial S) \cdot \Delta S^c\}$$
$(i = 1 \text{ to } n)$.

* * * * *